US008225884B2

(12) United States Patent
Nackerud

(10) Patent No.: US 8,225,884 B2
(45) Date of Patent: Jul. 24, 2012

(54) ROTOR UNDERREAMER, SECTION MILL, CASING CUTTER, CASING SCRAPER AND DRILL STRING CENTRALIZER

(76) Inventor: Alan L. Nackerud, Littleton, CO (US)

( * ) Notice: Subject to any disclaimer, the term of this patent is extended or adjusted under 35 U.S.C. 154(b) by 289 days.

(21) Appl. No.: 12/586,026

(22) Filed: Sep. 16, 2009

(65) Prior Publication Data

US 2010/0065264 A1 Mar. 18, 2010

Related U.S. Application Data

(60) Provisional application No. 61/192,270, filed on Sep. 17, 2008.

(51) Int. Cl.
*E21B 17/00* (2006.01)
*E21B 10/38* (2006.01)
*E21B 37/00* (2006.01)

(52) U.S. Cl. ..... 175/269; 175/325.2; 166/173

(58) Field of Classification Search ..... 166/65.1, 166/318, 384; 175/57, 63, 73, 318, 324, 175/325.1

See application file for complete search history.

(56) References Cited

U.S. PATENT DOCUMENTS 7,036,611 B2 5/2006 Radford et al.
7,650,951 B1 * 1/2010 Hall et al. ..... 175/57

* cited by examiner

*Primary Examiner* — Kenneth L Thompson
*Assistant Examiner* — Michael Wills, III

(57) ABSTRACT

A down hole well bore apparatus to underream and remove rock or cement or other material, cut or mill casing, clean or scrape casing, or centralize a drill string, which has a rotor which actuates blades, a compact overall length and can be operated with normal or reverse circulation. Simultaneous operations or multiple sequential operations can be made without removing the drill string.

19 Claims, 15 Drawing Sheets

ROTOR UNDERREAMER, SECTION MILL, CASING CUTTER, CASING SCRAPER AND DRILL STRING CENTRALIZER

CROSS-REFERENCE TO RELATED APPLICATIONS

This application claims the benefit of provisional patent application Ser. No. 61/192,270 filed Sep. 17, 2008 by Alan L. Nackerud, which is incorporated by reference herein.

BACKGROUND AND FIELD OF INVENTION

This invention generally relates to down hole tools, specifically to underreamers, section mills, casing cutters, casing scrapers and drill string centralizers.

Most conventional underreamers, section mills, casing cutters, casing scrapers and drill string centralizers open via pump pressure and compression spring which actuate blades to an outward position longitudinally from the drill string. This only allows a limited small number of blades to be used and then only a limited amount of cutting surface is available to ream, cut, mill, scrape, or centralize. The present invention can be used in different forms as an underreamer, section mill, casing cutter, casing scraper or drill string centralizer but will be hereinafter collectively referred to as Underreamer. The present invention Underreamer provides for one or more turbines and rotor to actuate blades axially from the drill string, which allows more blades to be used to more effectively centralize the tool. The Underreamer also enables the blades to be larger in height than conventional tools to provide more surface area to be worn away or used which significantly increases the available time to ream, mill or cut without removing or tripping the drill string and replacing or refurbishing the tool. The Underreamer can be used with normal fluid circulation down through the drill pipe and returned to the surface via the annulus, or unlike most conventional tools can also be reverse circulated down the annulus and back to the surface via the inside of the drill string. Reverse circulation is necessary in large diameter or extended length bore holes where a large borehole volume cannot be continuously pumped clear with normal circulation due to available pumping equipment or reservoir pressures unable to sustain the pressure. An additional feature of the tool is its strength and compact length relative to conventional tools. One of the benefits to compactness is that logging or directional drilling tools or other equipment can be located closer to the leading drill bit for more accurate information. The Underreamer also has the advantage of being able to work while advancing or retreating.

Representative patents are U.S. Pat. No. 7,036,611 to Steven R. Radford, et al. and 7,650,951 to Hall et al.

SUMMARY OF THE INVENTION

The above and other advantages and features will become more readily appreciated and understood from a consideration of the following detailed description of different embodiments when taken together with the accompanying drawings in which:

DRAWINGS

Figures

REFERENCE NUMERALS

Figure 1:
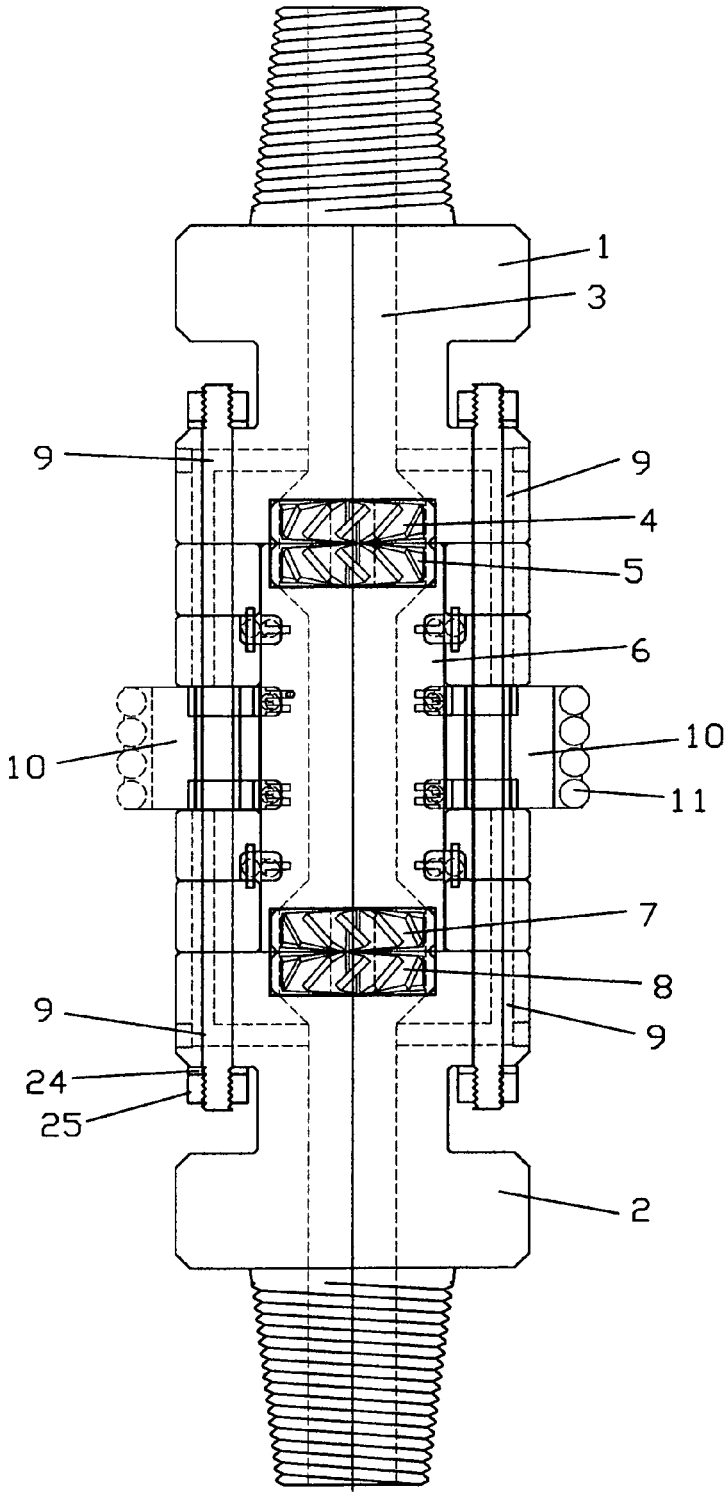
FIG. 1 is a side section view of assembled tool (first form)
Figure 2:
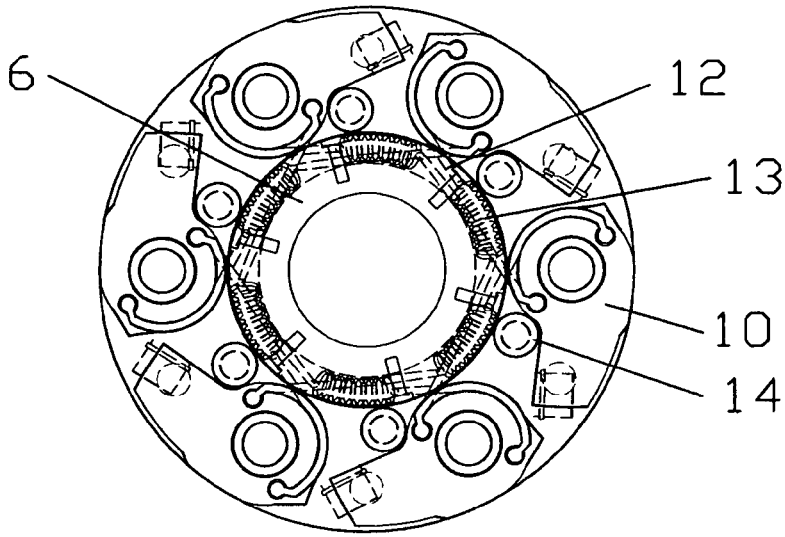
FIG. 2 is a top view of bottom inner cylindrical plate and blades in closed position (first, second and third form)
Figure 3:
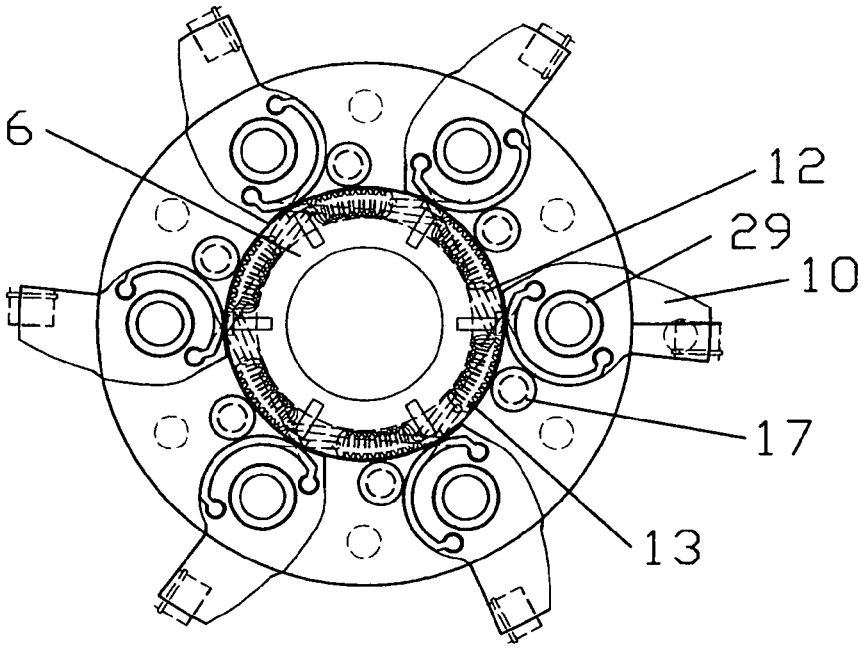
FIG. 3 is a top view of bottom inner cylindrical plate and blades in open position (first, second and third form)
Figure 4:
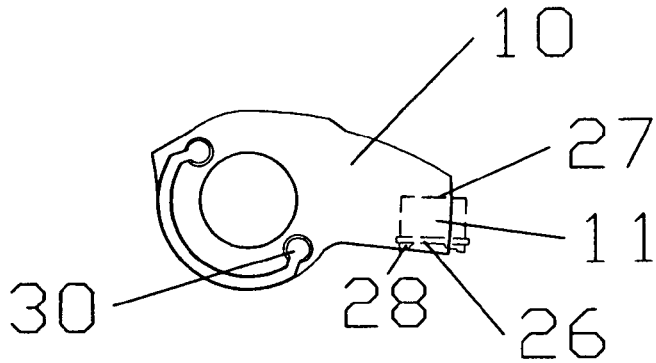
FIG. 4 is a top view of blade (first form)
Figure 5:
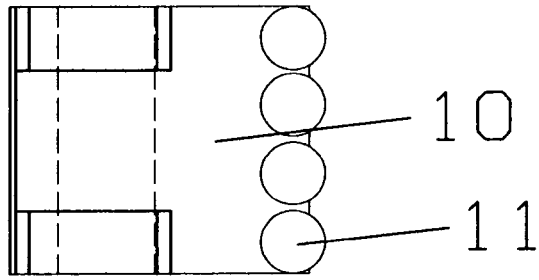
FIG. 5 is a side view of blade (first form)
Figure 6:
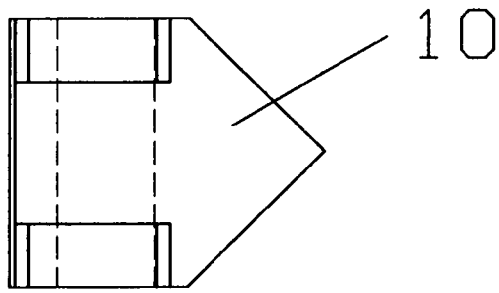
FIG. 6 is a side view of blade as a casing cutter (first form)
Figure 7:
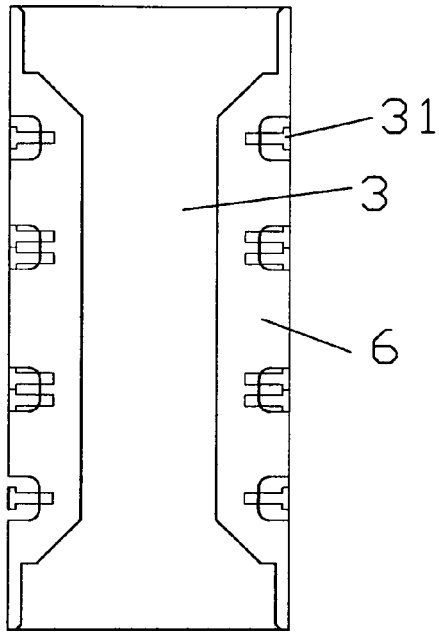
FIG. 7 is a side section view of rotor (first and second form)
Figure 8:
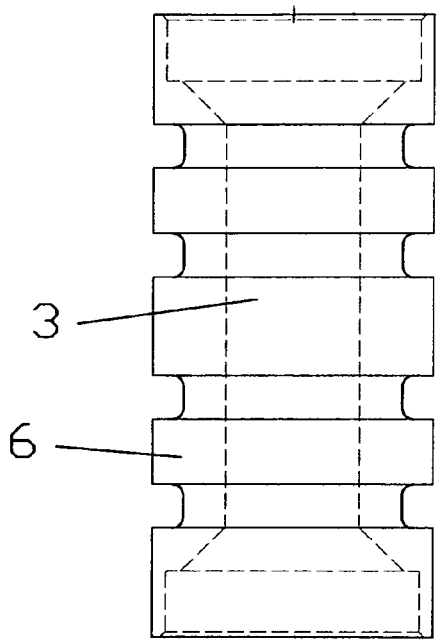
FIG. 8 is a side view of rotor (first and second form)
Figure 9:
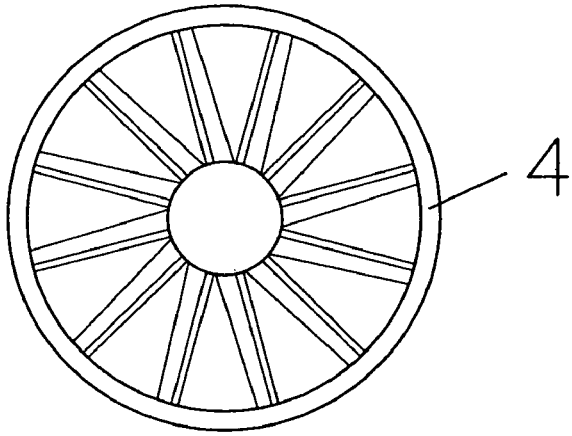
FIG. 9 is a top view of rotor (stator) turbine (first and second form)
Figure 10:
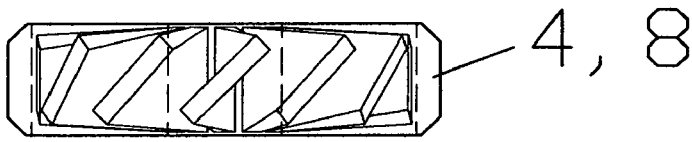
FIG. 10 is a side view of rotor (stator) turbine (first and second form)
Figure 11:
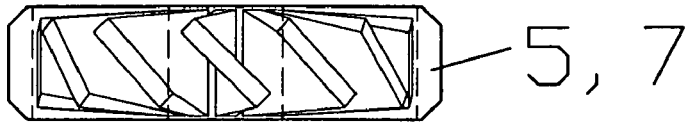
FIG. 11 is a side view of rotor (stator) turbine with reversed blades (first and second form)
Figure 12:
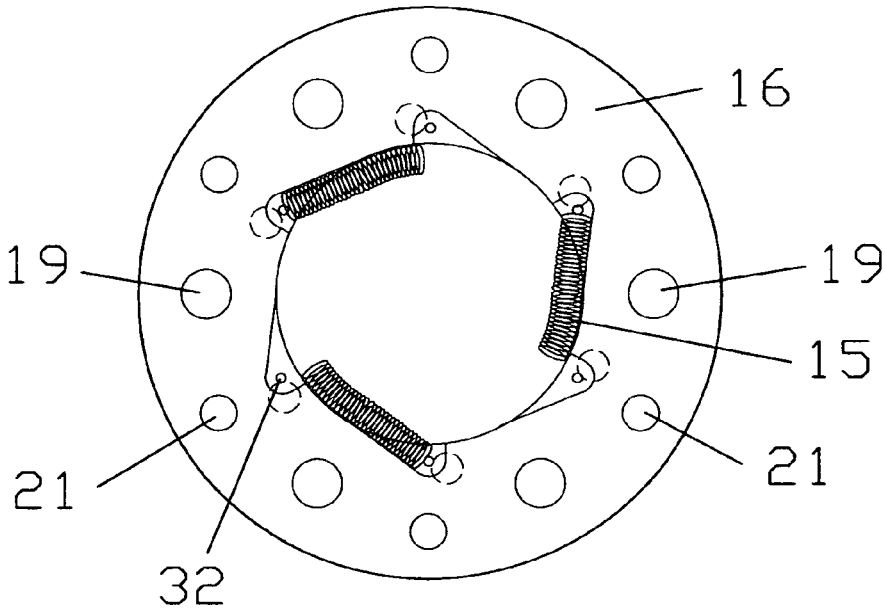
FIG. 12 is a top view of inner cylindrical plate (first, second and third form)
Figure 13:
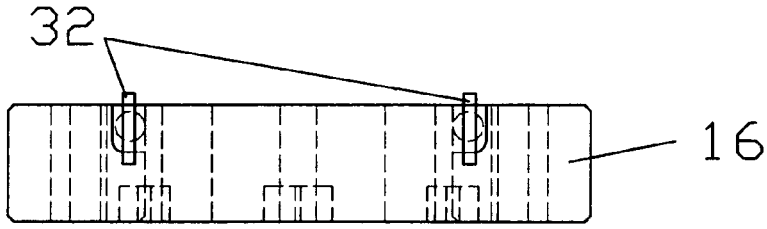
FIG. 13 is a side view of top inner cylindrical plate (first, second and third form)
Figure 14:
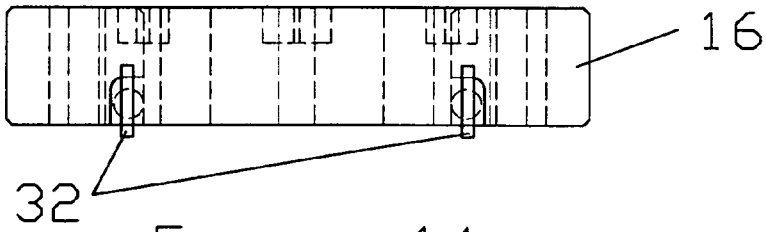
FIG. 14 is a side view of the bottom inner cylindrical plate (first, second and third form)
Figure 15:
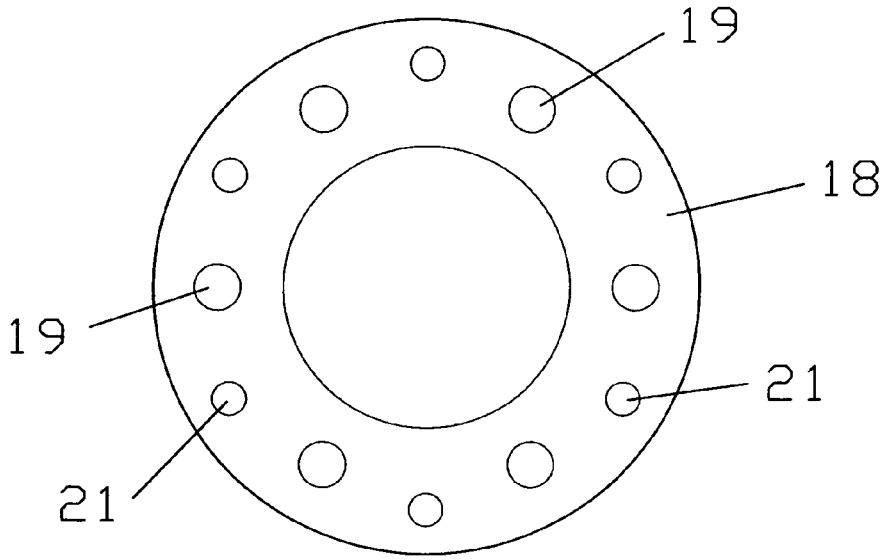
FIG. 15 is a top view of outer cylindrical plate (first, second and third form)
Figure 16:
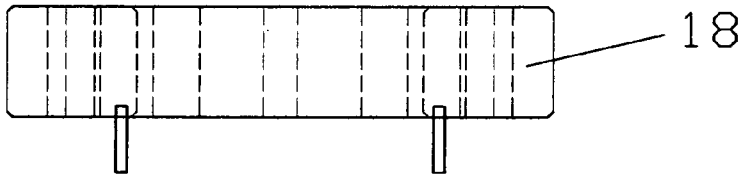
FIG. 16 is a side view of top outer cylindrical plate (first, second and third form)
Figure 17:
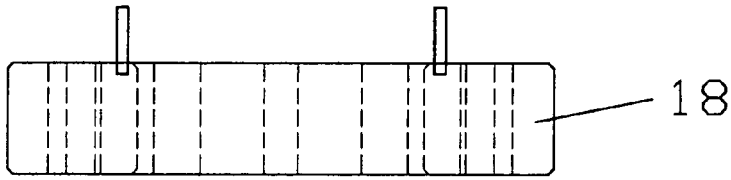
FIG. 17 is a side view of bottom outer cylindrical plate (first, second and third form)
Figure 18:
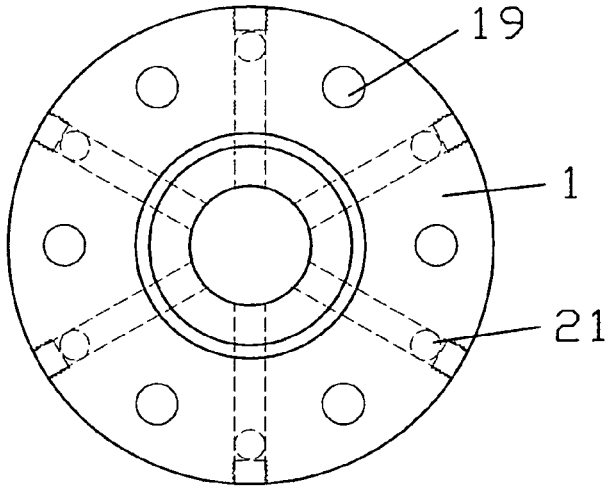
FIG. 18 is a bottom view of top threaded connection flange (first, second and third form)
Figure 19:
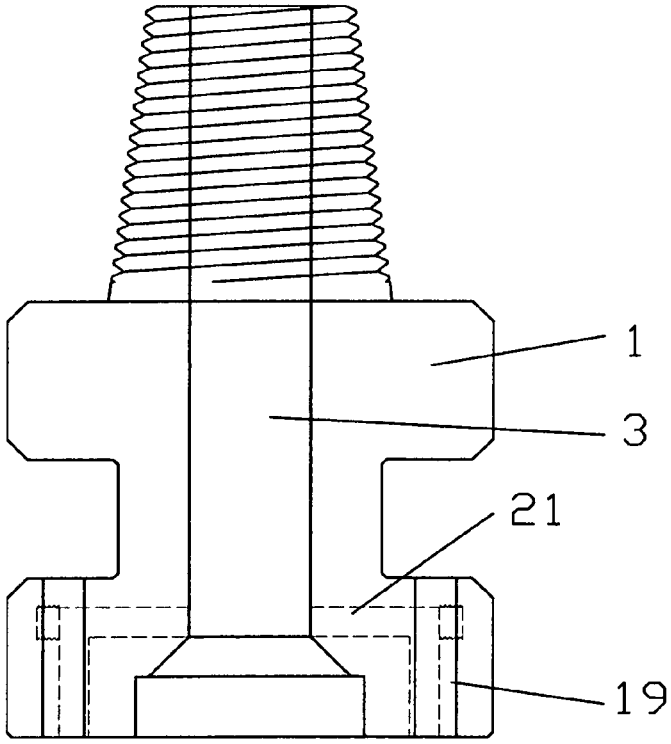
FIG. 19 is a side section view of top threaded connection flange (first, second and third form)
Figure 20:
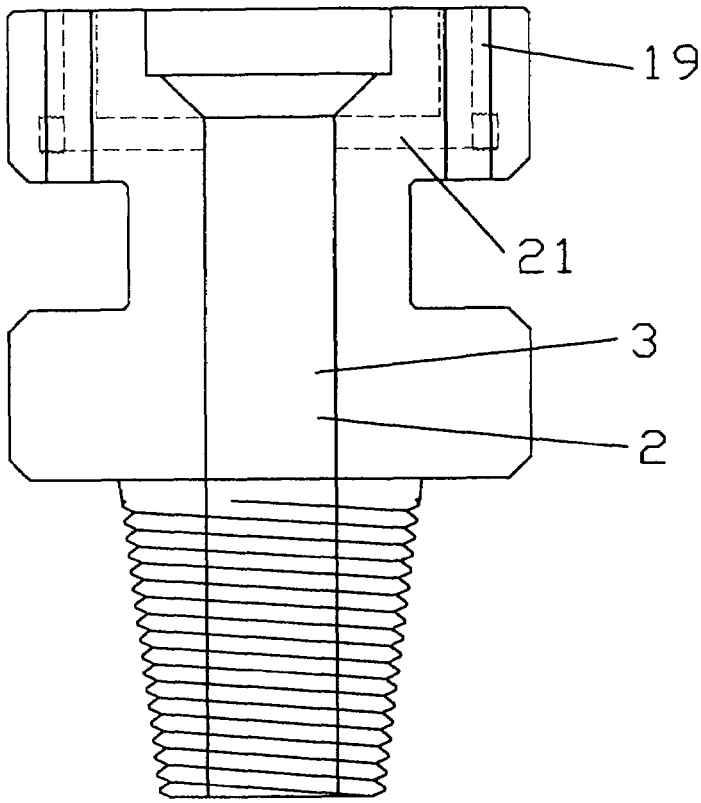
FIG. 20 is a side section view of bottom threaded connection flange (first, second and third form)
Figure 21:
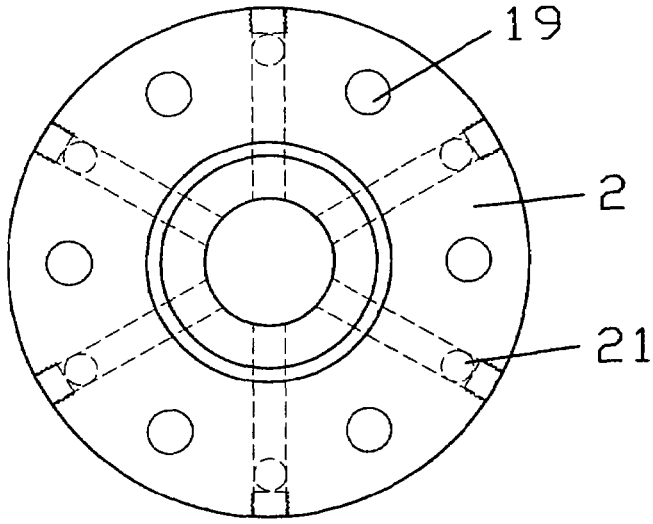
FIG. 21 is a top view of bottom threaded connection flange (first, second and third form)
Figure 22:
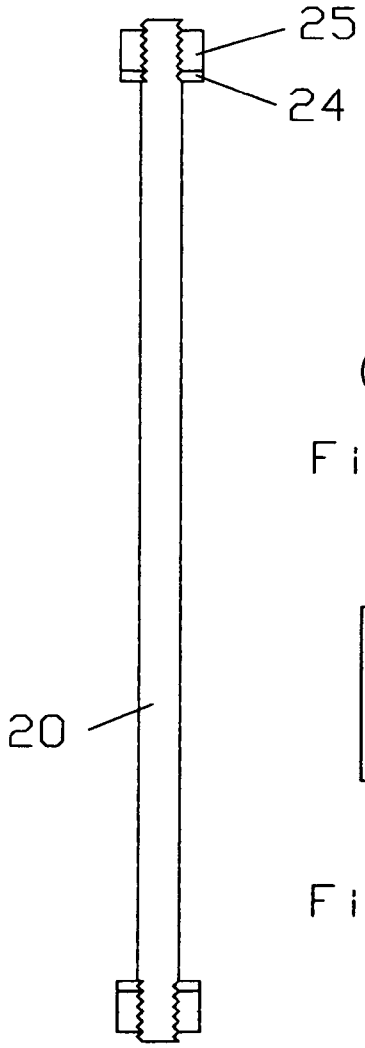
FIG. 22 is a side section view of bolt (first, second and third form)
Figure 23:
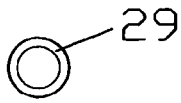
FIG. 23 is a top view of blade sleeve (first, second and third form)
Figure 25:
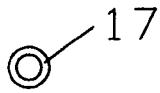
FIG. 25 is a top view of gap cylinder pin (first, second and third form)
Figure 24:
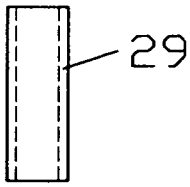
FIG. 24 is a side view of blade sleeve (first, second and third form)
Figure 26:
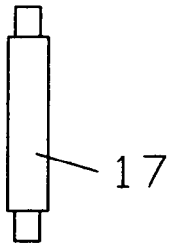
FIG. 26 is a side view of gap cylinder pin (first, second and third form)

1. top threaded connection flange
2. bottom threaded connection flange
3. main fluid bore
4. top stator turbine
5. top rotor turbine
6. rotor
7. bottom rotor turbine
8. bottom stator turbine
9. side bores
10. blades
11. cutters
12. wirelines
13. tension springs
14. stop cylinder pins
15. rotor springs
16. inner cylindrical plates
17. gap cylinder pins
18. outer cylindrical plates
19. bolt holes
20. blade flange bolts
21. smaller bores
22. elongated steel block
23. blade flange bolt
24. washers
25. nuts
26. ring groove
27. cutter pocket
28. brazing material
29. blade sleeves
30. wire line pockets
31. rotor bolts
32. small pins
33. stator retention pins
34. rotor retention pins
35. blade teeth
36. rotor slots

DETAILED DESCRIPTION-FORMS FIRST, SECOND, AND THIRD

Figure 28:
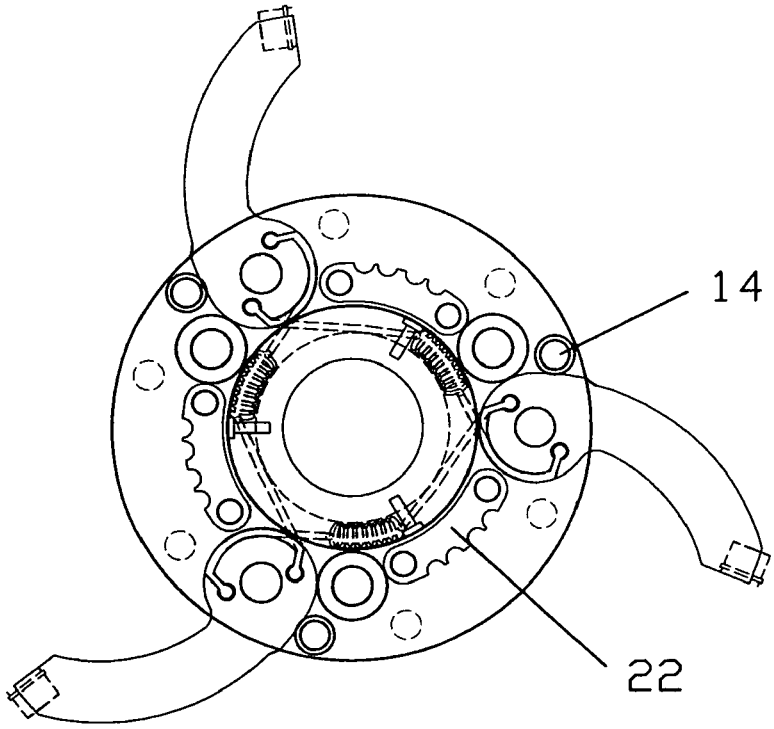
FIG. 28 is a top view of modified embodiment of bottom inner cylindrical plate with three blades in open position (second form)
Figure 29:
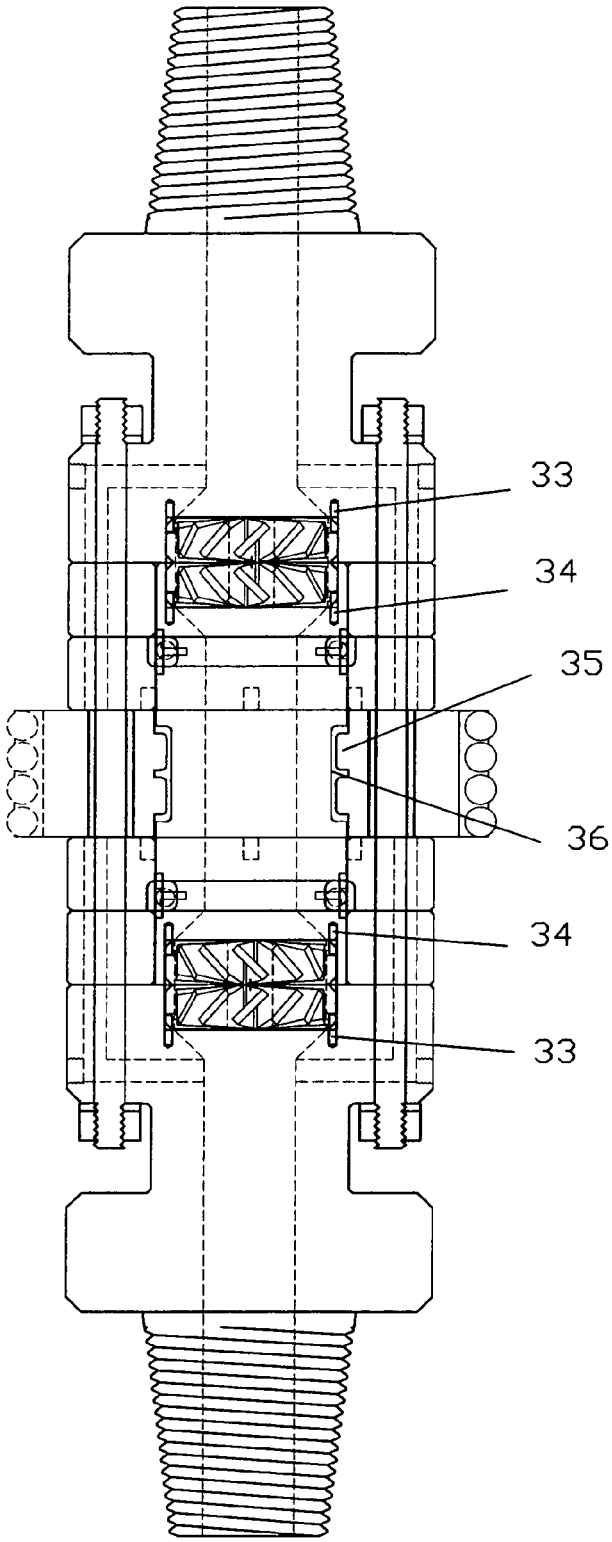
FIG. 29 is a side section view of assembled tool (third form)
Figure 30:
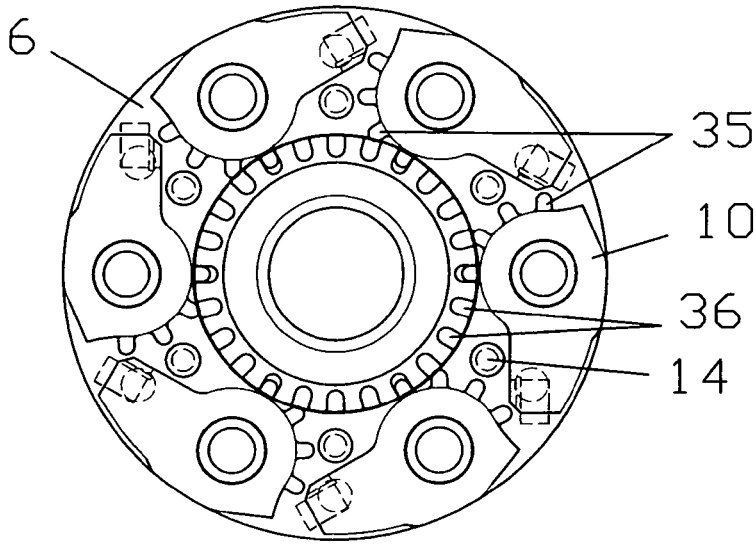
FIG. 30 is a top view of bottom inner cylindrical plate and blades in closed position (third form)
Figure 31:
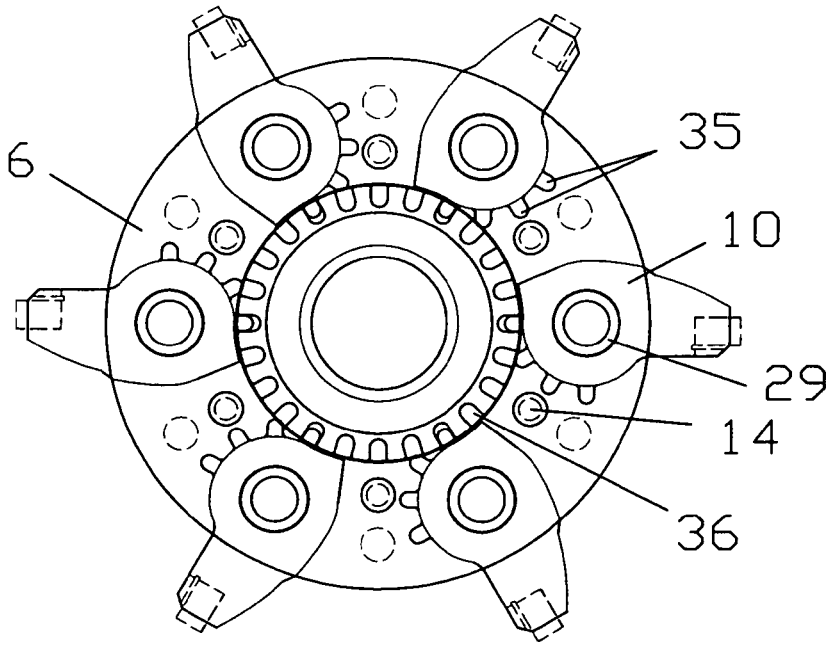
FIG. 31 is a top view of bottom inner cylindrical plate and blades in open position (third form)
Figure 32:
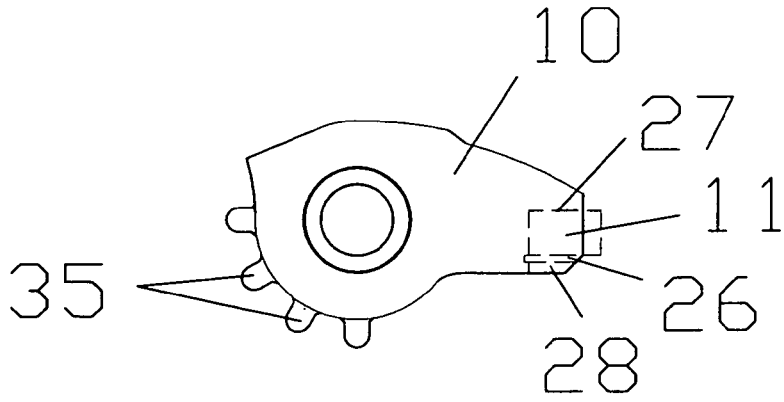
FIG. 32 is a top view of blade (third form)
Figure 33:
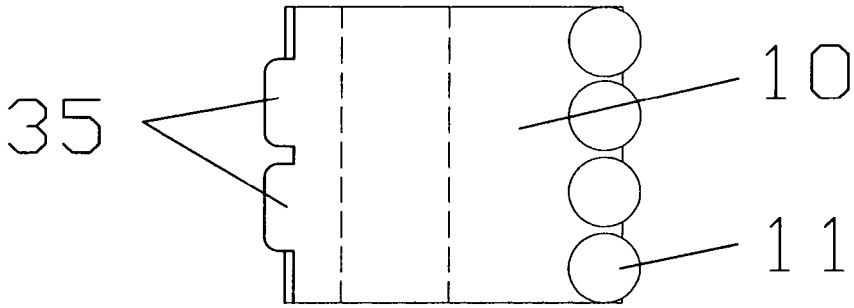
FIG. 33 is a side view of blade (third form)
Figure 34:
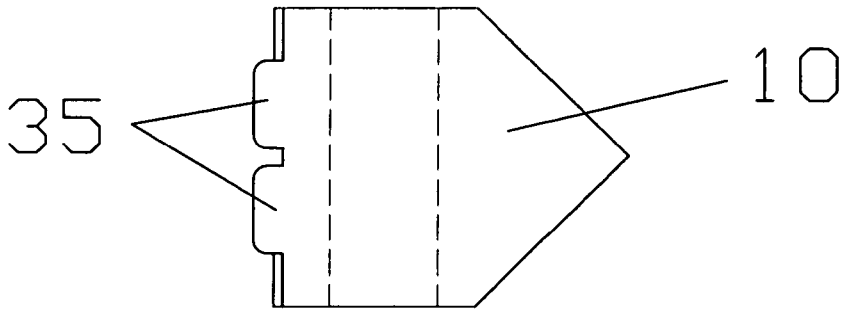
FIG. 34 is a side view of blade as a casing cutter (third form)
Figure 35:
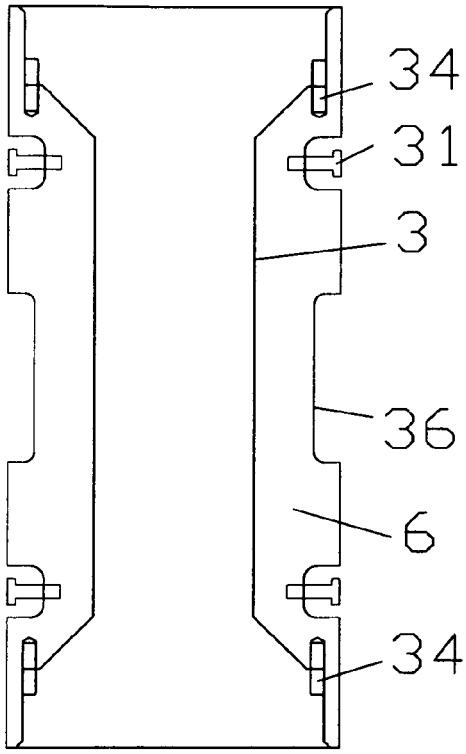
FIG. 35 is a side section view of rotor (third form)
Figure 36:
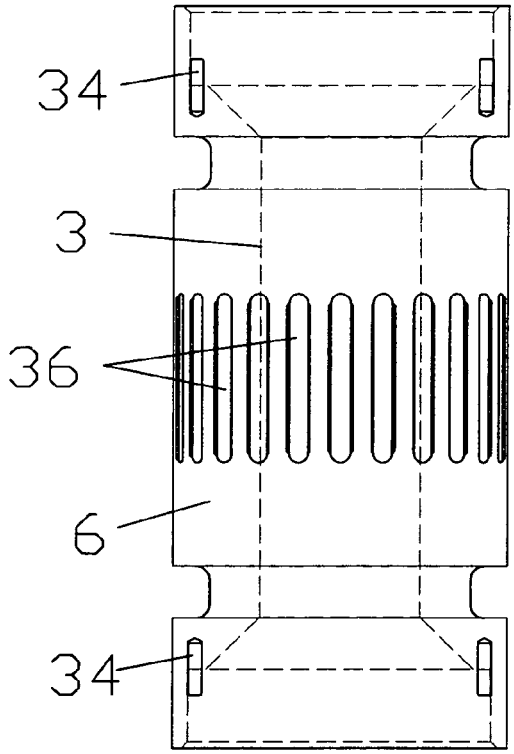
FIG. 36 is a side view of rotor (third form)

Referring to the drawings, there is illustrated in FIGS. 1 through 36 three forms of the Underreamer. In FIG. 1 (First Form of Underreamer) the Underreamer has a top threaded connection flange 1 and a bottom threaded connection flange 2 to allow connection to a drill string. A main fluid bore 3 runs through the top pin connection and through a top stator turbine 4 then through a top rotor turbine 5, then through the rotor 6, then through a bottom rotor turbine 7 and bottom stator turbine 8, then through a bottom threaded connection flange 2 and onward to any preceding assembly. Some fluid enters small side bores 9 allowing fluid to expel directly above and below the Underreamer blades 10 for cooling, cleaning, and cuttings removal near the blades 10. The small side bores 9 also allow indication at the ground surface that the Underreamer blades 10 have opened when a slight reduction in fluid pumping pressure is indicated. The stator turbines 4, 8 and rotor turbines 5, 7 can be welded to the threaded connection flanges 1, 2 and rotor 6 or held alternatively in place by stator retention pins 33 and rotor retention pins 34 respectively as shown in FIGS. 29, 35 and 36 (Third form of Underreamer).

Figure 27:
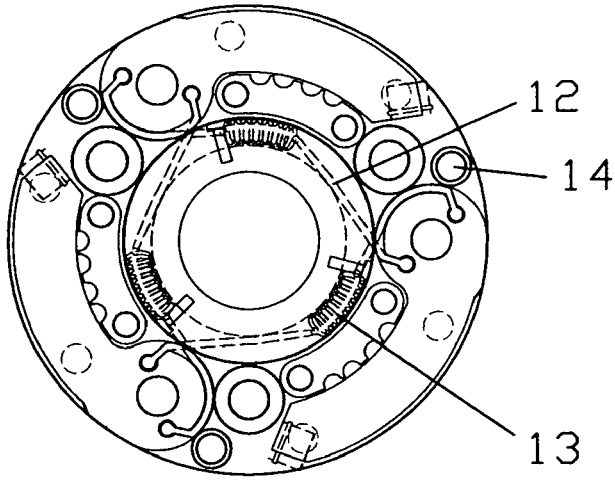
FIG. 27 is a top view of modified embodiment of bottom inner cylindrical plate with three blades in closed position (second form)

The Underreamer has one or more blades 10 for hole enlargement cutting (e.g. rock or cement), or milling (e.g. casing or pipe), or cutting a piece of casing or pipe into two pieces, or centralizing a drill string in a bore. The blades 10 can be tipped or profiled with cutters 11 or other various hardened materials to prolong blade life. The six bladed Underreamer would have the advantage of keeping the Underreamer more centralized in the hole, especially in horizontal or deviated drilling where the tendency is for the drill string to key seat against the hole wall and become stuck. Another embodiment of the Underreamer is shown in FIGS. 27, 28 (Second Form of Underreamer) which has three blades capable of larger hole enlargement than the six bladed Underreamer. The blades 10 are kept in their closed position by wire lines 12 and tension springs 13 attached from the blades 10 to the independent rotor 6. The wire lines 12 and tension springs 13 are connected to the blades 10 by the wire line pockets 30 in the blades 10. The tension springs 13 are attached to the rotor 6 by rotor bolts 31. Other means of connection could be used. The blades 10 are opened when both the drill string is rotated and centrifugal force actuates the blades to an open position and also when fluid is pumped through the rotor turbines 5, 7 and actuates or forces a partial revolution of the rotor 6 which pulls the wire lines 12 attached to the blades 10 and rotates the blades 10 to an open position. The stator turbines 4, 8 more efficiently direct the drilling fluid for maximum force upon the rotor turbines 5, 7 however the Underreamer would operate without the stator turbines 5, 7. The drawings illustrate two rotor turbines 5, 7 however only one rotor turbine 5 or 7 is necessary to operate the Underreamer. The blades 10 open to the point where a blade protrusion abuts the rotor 6. Stop cylinder pins 14 are shown as an alternative blade stop means in FIG. 27, 28 (Second Form of Underreamer). After reaming, cutting, milling or centralization, rotation and fluid pumping are both stopped. The rotor 6 then retracts back to its original position by the retraction of the rotor springs 15, blade wire lines 12 and tension springs 13. The rotor springs 15 are attached to the inner cylindrical plates 16 by small pins 32 and attached to the rotor 6 by rotor bolts 31. An alternative method of blades 10 actuation or opening is shown in FIGS. 29 through 36 (Third Form of Underreamer) where blade teeth 35 fit in rotor slots 36 whereby when rotor 6 rotates the blades 10 open and close.

Above and below the blade 10 area there are two sets of cylindrical plates. The first set of inner cylindrical plates 16 are set immediately above and below the blades 10 to retain the blades 10, blade wire lines 12 and tension springs 13. A proper gap to allow blade 10 rotation is maintained by stop cylinder pins 14, gap cylinder pins 17 and blade sleeves 29. The cylindrical plates 16, 18 also have bolt holes 19 drilled through them to align the blade flange bolts 20. The cylindrical plates 16, 18 also have smaller bores 21 through them which deliver fluid to the blade 10 area. The gap cylinder pins 17, positioned close to the rotor 6, minimize cuttings or debris from accumulating against the rotor 6 or in the area where the blades 10 need to retract to close. The three bladed Underreamer shows an elongated steel block 22 in lieu of a gap cylinder pin 17 to fill the area next to the rotor 6. The gap cylinder pins 17 also provide for the proper gap or distance between the inner cylindrical plates 16 so that the blades 10 are not squeezed but are allowed to rotate.

The outer cylindrical plates 18 above and below the inner cylindrical plates 16 allows the insertion of the rotor springs 15 which rotate the rotor 6 back to its original blade 10 closed position when pumping is stopped. They also have bolt holes 19 to align the blade flange bolts 20. They also have smaller bores 21 to deliver fluid to the blade area.

A blade flange bolt 20 for each blade 10 runs through the top and bottom connection flanges. These blade flange bolts 20 allow the blades 10 to rotate on an axis and keep the various parts of the Underreamer together. There are washers 24 and nuts 25 at each end of the blade flange bolts 20. In a three bladed Underreamer, three additional bolts on top and three additional bolts on bottom could be placed in positions where the six bladed Underreamer blade flange bolts are located, however they would be shorter so as to not go through the blade area (this would interfere with the three blades) but rather be threaded into the inner cylindrical plates 16 for added strength to keep the Underreamer together. As an alternative a threaded body section could be used in lieu of the bolt flange system. Gaskets can be placed between the inner and outer cylindrical plates 16, 18 and top and bottom threaded connection flanges 1, 2 to seal fluid from leaking. If desired a cylindrical cover could be used over the bolt nut areas, which could be kept in place by set crews or other means to prevent cutting or debris from filling the open area or to prevent catching borehole irregularities or material when tripping in or out of the borehole.

When the blades 10 become worn from use, they can be easily removed and rebuilt or replaced. The cutters 11 or other cutting material in or on the blades 10 can be brazed into pockets, pressed into place or some other attachment or retention method used. The cutters 11 can have enhanced brazed retention by cutting a ring groove 26 in each cutter pocket 27 just above the top of the cutter 11. When the brazing material 28 is heated it runs into the void between the cutter 11 and cutter pocket 27 and also fills the ring groove 26. When it fills the ring groove 26 it pools (overlaps) onto the cutter 11 top enhancing retention similar to a snap ring retention device. This is especially beneficial with polycrystalline diamond compact (a/k/a PDC) cutters 11 due to the fact that the diamond does not bond well to brazing material 28.

Another feature of the Underreamer is that combined operations such as section milling of casing could be done and then reaming of borehole could be done without tripping out the drill string to change tools. More than one Underreamer could be stacked in the drill string whereby one Underreamer with normal positioned rotor turbines 5, 7 and stator turbines 4, 8 could be used as a section mill to remove casing with normal circulation to open the blades and then without tripping the drill string to change tools the second Underreamer with reversed position rotor turbines 5, 7 and stator turbines 4, 8 could be opened with reverse circulation. In other words normal circulation would open the first Underreamer as a section mill tool to remove casing while the second Underreamer is closed, where after subsequent reverse circulation would close the first Underreamer and open the second Underreamer to ream.

It is therefore to be understood that even though numerous characteristics and advantages of the present embodiment have been set forth in the foregoing description, together with the details of the structure and function of the embodiment, the disclosure is illustrative only, and changes may be made within the principles of the embodiment to the full extent indicated by the broad general meaning of the terms in which the appended claims are expressed and reasonable equivalents thereof.

I claim:

1. A down hole well bore apparatus to underream and remove rock or cement or other material, cut or mill casing, clean or scrape casing, or centralize a drill string, comprising:

(a) two threaded connection flanges whereby said apparatus is connected to a drill string and wherein a main fluid bore runs through the center of said flanges whereby drilling fluid is pumped through, and (b) one or more stator turbines located inside said flanges, and (c) one or more stator retention pins which hold said stator turbines in a stationary position relative to said flange, and (d) one or more cylindrical plates located between said flanges, and (e) at least one rotatable rotor located within said cylindrical plates, and (f) one or more rotor turbines located within said rotor, and (g) one or more rotor retention pins which hold said rotor turbines in a stationary position relative to said rotor, and (h) one or more rotor springs and rotor bolts which connect said rotor to at least one said cylindrical plate, and (i) one or more rotatable blades located between said cylindrical plates and flanges and adjacent to said rotor, and (j) one or more blade flange bolts, washers and nuts, which run through and hold together said flanges, said plates, and said blades, and which also provide a bearing axis means upon which the blades may rotate to an open and closed position, and (k) one or more blade sleeves which are located in the bores running longitudinally through said blades of which said blade flange bolts run through said sleeves and of which the sleeves are slightly longer in height than the blades which allow said plates and said flanges to be held together yet allow the blades to freely rotate, and (l) one or more wirelines and tension springs which connect said blades to said rotor whereby when fluid is pumped through said rotor turbine and the rotor said fluid imparts a partial revolution of the rotor which actuates the blades to an open position until the blades abut a stop cylinder pin whereby when fluid is not pumped the rotor returns to its original position whereby the blades also return to their original closed position.

2. In an apparatus according to claim 1 wherein one or more smaller bores direct some fluid radially out from the main fluid bore in said flanges which then communicate with longitudinal bores in the flanges and proceed toward the cylindrical plates which then meet and communicate with the smaller bores in the cylindrical plates whereby fluid is expelled out near the blades whereby the apparatus is cooled and the blade area is kept clean and cuttings removal from the well bore is assisted.

3. In an apparatus according to claim 1 wherein only one, two or three blades are attached whereby said blades are longer than an apparatus with more numerous blades and thereby able to reach a larger diameter when open.

4. In an apparatus according to claim 1 wherein numerous cutters are inserted in cutter pockets and retained by braze material in ring grooves machined or forged in said cutter pockets wherein the braze material are located inside said grooves and overlapping said cutting elements whereby better retention is achieved.

5. A down hole well bore apparatus to underream and remove rock or cement or other material, cut or mill casing, clean or scrape casing, or centralize a drill string, comprising:

(a) two threaded connection flanges whereby said apparatus is connected to a drill string and wherein a main fluid bore runs through the center of said flanges whereby drilling fluid may be pumped through, and (b) one or more cylindrical plates located between said flanges, and (c) at least one rotatable rotor located within said cylindrical plates, and (d) one or more rotor turbines located within said rotor, and (e) one or more rotor retention pins which hold said rotor turbines in a stationary position relative to said rotor, and (f) one or more rotor springs and rotor bolts which connect said rotor to at least one said cylindrical plate, and (g) one or more rotatable blades located between said cylindrical plates and flanges and adjacent to said rotor, and (h) one or more blade flange bolts, washers and nuts, which run through and hold together said flanges, said plates, and said blades, and which also provide a bearing axis means upon which the blades rotate to an open and closed position, and (i) one or more blade sleeves which are located in the bores running longitudinally through said blades of which said blade flange bolts run through said sleeves and of which the sleeves are slightly longer in height than the blades which allow said plates and said flanges to be held together yet allow the blades to freely rotate, and (j) one or more wirelines and tension springs which connect said blades to said rotor whereby when fluid is pumped through said rotor turbine and the rotor said fluid imparts a partial revolution of the rotor which actuates the blades to an open position until the blades abut a stop cylinder pin whereby when fluid is not pumped the rotor returns to said rotors original position whereby the blades also return to their original closed position.

6. In an apparatus according to claim 5 wherein one or more smaller bores direct some fluid radially out from the main fluid bore in said flanges which then communicate with longitudinal bores in the flanges and proceed toward the cylindrical plates which then meet and communicate with the smaller bores in the cylindrical plates whereby the fluid is then expelled out near the blades whereby the apparatus is cooled and the blade area kept clean and cuttings removal from the well bore is assisted.

7. In an apparatus according to claim 6 wherein numerous cutters are inserted in cutter pockets and retained by braze material in ring grooves machined or forged in said cutter pockets wherein the braze material are located inside said grooves and overlapping said cutting elements whereby better retention is achieved.

8. In an apparatus according to claim 5 wherein only one, two or three blades are attached whereby said blades can be longer than an apparatus with more numerous blades and thereby able to reach a larger diameter when open.

9. In an apparatus according to claim 8 wherein one or more smaller bores direct some fluid radially out from the main fluid bore in said flanges which then communicate with longitudinal bores in the flanges and proceed toward the cylindrical plates which then meet and communicate with the smaller bores in the cylindrical plates whereby the fluid is then expelled out near the blades whereby the apparatus is cooled and the blade area kept clean and cuttings removal from the well bore is assisted.

10. In an apparatus according to claim 9 wherein numerous cutters are inserted in cutter pockets and retained by braze material in ring grooves machined or forged in said cutter pockets wherein the braze material are located inside said grooves and overlapping said cutting elements whereby better retention is achieved.

11. In an apparatus according to claim 5 wherein numerous cutters are inserted in cutter pockets and retained by braze material in ring grooves machined or forged in said cutter pockets wherein the braze material or are located inside said grooves and overlapping said cutting elements whereby better retention is achieved.

12. A down hole well bore apparatus to underream and remove rock or cement or other material, cut or mill casing, clean or scrape casing, or centralize a drill string, comprising:

(a) two threaded connection flanges whereby said apparatus is connected to a drill string and wherein a main fluid bore runs through the center of said flanges whereby drilling fluid is pumped through, and (b) one or more cylindrical plates located between said flanges, and (c) at least one rotatable rotor located within said cylindrical plates, and (d) one or more rotor turbines located within said rotor, and (e) one or more rotor retention pins which hold said rotor turbines in a stationary position relative to said rotor, and (f) one or more rotor springs and rotor bolts which connect said rotor to at least one said cylindrical plate, and (g) one or more rotatable blades located between said cylindrical plates and flanges and adjacent to said rotor, and (h) one or more blade flange bolts, washers and nuts, which run through and hold together said flanges, said plates, and said blades, and which also provide a bearing axis means upon which the blades rotate to an open and closed position, and (i) one or more blade sleeves which are located in the bores running longitudinally through said blades of which said blade flange bolts run through said sleeves and of which the sleeves are slightly longer in height than the blades which allow said plates and said flanges to be held together yet allow the blades to freely rotate, and (j) whereon said rotor has numerous recessed rotor slots located around said rotor perimeter which mate with protruding blade teeth on said blades whereby when fluid is pumped through said rotor turbine and rotor said fluid imparts a partial revolution of the rotor which actuates the blades to an open position, and whereby when fluid is not pumped the rotor returns to said rotor original position whereby the blades also return to their original closed position.

13. In an apparatus according to claim 12 wherein one or more stator turbines are located inside said flanges and wherein one or more stator retention pins hold said stator turbines in a stationary position relative to said flanges.

14. In an apparatus according to claim 12 wherein one or more smaller bores direct some fluid radially out from the main fluid bore in said flanges which then communicate with longitudinal bores in the flanges and toward the cylindrical plates which then meet and communicate with the smaller bores in said cylindrical plates whereby the fluid is then expelled out near the blades whereby the apparatus is cooled and the blade area kept clean and cuttings removal from the well bore is assisted.

15. In an apparatus according to claim 14 wherein numerous cutters are inserted in cutter pockets and retained by braze material in ring grooves machined or forged in said cutter pockets wherein the braze material are located inside said grooves and overlapping said cutting elements whereby better retention is achieved.

16. In an apparatus according to claim 12 wherein only one, two or three blades are attached whereby said blades are radially longer than an apparatus with more numerous blades and thereby able to reach a larger diameter when open.

17. In an apparatus according to claim 16 wherein one or more smaller bores direct some fluid radially out from the main fluid bore in said flanges which then communicate with longitudinal bores in the flanges and toward the cylindrical plates which then meet and communicate with the smaller bores in said cylindrical plates whereby the fluid is then expelled out near the blades whereby the apparatus is cooled and the blade area kept clean and cuttings removal from the well bore is assisted.

18. In an apparatus according to claim 17 wherein numerous cutters are inserted in cutter pockets and retained by braze material in ring grooves machined or forged in said cutter pockets wherein the braze material are located inside said grooves and overlapping said cutting elements whereby better retention is achieved.

19. In an apparatus according to claim 12 wherein numerous cutters are inserted in cutter pockets and retained by braze material in ring grooves machined or forged in said cutter pockets wherein the braze material are located inside said grooves and overlapping said cutting elements whereby better retention is achieved.

* * * * *